United States Patent [19]

Hamanaka

[11] Patent Number: 4,881,513

[45] Date of Patent: Nov. 21, 1989

[54] TWO-CYCLE INTERNAL COMBUSTION ENGINE

[75] Inventor: Tamotsu Hamanaka, Saitama, Japan

[73] Assignee: Tohatsu Corporation, Tokyo, Japan

[21] Appl. No.: 210,359

[22] Filed: Jun. 23, 1988

[30] Foreign Application Priority Data

Nov. 19, 1987 [JP] Japan ..... 62-292388

[51] Int. Cl.[4] ..... F02B 23/08; F02B 33/44

[52] U.S. Cl. ..... 123/664; 123/73 PP; 123/306

[58] Field of Search ..... 123/65 P, 73 A, 73 PP, 123/193 H, 257, 268, 306, 664

[56] References Cited

U.S. PATENT DOCUMENTS

| | | | |
|---|---|---|---|
| 2,062,013 | 11/1936 | Opolo | 123/664 X |
| 2,154,975 | 4/1939 | Dufour | 123/664 X |
| 4,201,175 | 5/1980 | Tanaka et al. | 123/306 X |
| 4,354,463 | 10/1982 | Otani et al. | 123/306 X |
| 4,452,221 | 6/1984 | Keating | 123/664 X |
| 4,706,622 | 11/1987 | Cloke et al. | 123/664 X |
| 4,821,687 | 4/1989 | Iwai | 123/73 PP X |

FOREIGN PATENT DOCUMENTS

| | | | |
|---|---|---|---|
| 0000516 | 1/1981 | Japan | 123/664 |
| 0035225 | 3/1983 | Japan | 123/306 |

*Primary Examiner*—Willis R. Wolfe

*Attorney, Agent, or Firm*—Pearne, Gordon, McCoy & Granger

[57] ABSTRACT

A two-cycle internal combustion engine capable of improving its output and a rate of feed consumption. In the engine, an ignition plug is so disposed that its tip end is arranged in a top chamber and positioned on a vertical plane extending through the top chamber and a partition is provided in a region of the top chamber apart from the ignition plug in a manner to extend substantially along the vertical plane from one end of the top chamber by a distance toward the ignition plug, to thereby divide the region into two compartments. The partition cooperates with the top chamber to form corners to both sides of the one end of the top chamber with the partition being interposed therebetween so that they may serve to direct fuel gas supplied to the top chamber toward the ignition plug.

11 Claims, 1 Drawing Sheet

TWO-CYCLE INTERNAL COMBUSTION ENGINE

BACKGROUND OF THE INVENTION

1. Field of the Invention

This invention relates to a two-cycle internal combustion engine, and more particularly to an improvement in a combustion chamber of a two-cycle internal combustion engine.

2. Description of the Prior Art

In general, a two-cycle internal combustion engine which is conventionally known in the art is typically constructed as shown in FIG. 1. More particularly, it includes a cylinder 10 having a side wall 12 formed with a plurality of opening or scavenging ports 14, a piston 16 vertically movably arranged in the cylinder 10 and a cylinder head 18 for closing an upper opening 20 of the cylinder 10. The so-arranged cylinder 10, piston 16 and cylinder head 18 cooperate together to form a combustion chamber 22. The cylinder head 18 comprises an upper section 24 of a dome-like shape formed therein with a space or top chamber 26 of a substantially hemispherical shape and a lower section 28 of a flat cylindrical shape communicated to a lower end of the upper dome-like section 24 and formed so as to serve as a lower flange of the upper dome-like section 24. The lower flat cylindrical section 28 is formed with a space or chamber 30 of a substantially frust-conical shape which is communicated with the top chamber 26 of the upper dome-like section 24 through a circumferential border 31 defined therebetween and serves as a squish chamber. The upper dome-like section 24 and lower flat cylindrical section 28 are formed integral each other. The internal combustion engine also includes an ignition plug 32 threadedly inserted through an upper portion of the upper dome-like section 24 so that its tip end 34 is positioned at a substantially central portion of the top chamber 26. The side wall 12 of the cylinder 10 is also formed with a discharge port 34 through which combustion gas is exhausted.

Unfortunately, the so-constructed conventional two-cycle internal combustion engine exhibits a disadvantage of failing to form a vortex flow of fuel gas in proximity to the tip end 34 of the ignition plug 32, resulting in a failure in an improvement of ignition performance of the engine, because the tip end is positioned at a substantially central portion of the top chamber 26 and fuel gas is merely forcedly fed through the squish chamber 30 to the top chamber 26 while being compressed before the piston 16 reaches a top dead center. This also leads to consumption of much fuel.

Further, when the ignition plug 32 ignites fuel gas in the top chamber 26, a flame of the fuel gas is propagated toward the piston 16 at a high velocity to cause pressure in the combustion chamber 22 to be rapidly increased, resulting in large impulse force being exerted on a head surface 38 of the piston 16, an inner surface 40 of the lower flat cylindrical section 28 defining the squish chamber 30 of the cylinder head 18, an inner surface 42 of the upper dome-like section 24 defining the top chamber 26 of the cylinder head 18 and the like, so that vibration occur at the piston 16, cylinder head 18 and cylinder 10 to cause resonance, resulting in noise. In order to eliminate such a problem, it is attempted to form the top chamber 26 into a large depth to increase a distance from a position of ignition of fuel gas by the ignition plug 32 to the squish chamber 30, to thereby lengthen a time required for propagation of a flame.

Unfortunately, such an approach fails to cause a sufficient amount of fuel gas to be present at the ignition position to deteriorate ignition performance of the engine, resulting in an output of the engine being decreased and much fuel being consumed. Also, this renders clarification of exhaust gas difficult.

SUMMARY OF THE INVENTION

The present invention has been made in view of the foregoing disadvantages of the prior art.

Accordingly, it is an object of the present invention to provide a two-cycle internal combustion engine which is capable of improving its output while significantly decreasing fuel consumption.

It is another object of the present invention to provide a two-cycle internal combustion engine which is capable of improving a rate of fuel consumption to decrease a content of noxious gas such as carbon monoxide in exhaust gas.

It is a further object of the present invention to provide a two-cycle internal combustion engine which is capable of minimizing generation of vibration to decrease noise.

It is still another object of the present invention to provide a two-cycle internal combustion engine which is capable of providing fuel gas in a combustion chamber with swirling motion to increase a rate of fuel consumption.

In accordance with the present invention, a two-cycle internal combustion engine is provided. The two-cycle internal combustion engine includes a cylinder having a cylinder wall formed with a plurality of scavenging ports and a discharge port, a cylinder head for covering a top of the cylinder and a piston movably arranged in the cylinder, which cooperate together to define a combustion chamber. The cylinder head is formed therein with a top chamber constituting a part of the combustion chamber. The engine also includes an ignition plug of which a tip end is arranged in the top chamber and positioned on a vertical plane extending through the top chamber and a partition provided in a region of the top chamber apart from the ignition plug in a manner to extend substantially along the vertical plane from one end of the top chamber by a distance toward the ignition plug, to thereby divide the region into two compartments. The partition cooperates with the top chamber to form corners onto the sides of the one end of the top chamber with the partition being interposed therebetween. The corners serve to direct fuel gas supplied to said top chamber toward the ignition plug. The scavenging ports are arranged to feed fuel gas through the partition to the corners and the exhaust port is arranged on a side of the cylinder wall opposite to the corners.

BRIEF DESCRIPTION OF THE DRAWINGS

These and other objects and many of the attendant advantages of the present invention will be readily understood as the same becomes better understood by reference to the following detailed description when considered in connection with the accompanying drawings in which like reference numerals designate like or corresponding parts throughout, wherein.

DETAILED DESCRIPTION OF THE PREFERRED EMBODIMENT

Now, a two-cycle internal combustion engine according to the present invention will be described hereinafter with reference to FIGS. 2 to 5 illustrating an embodiment of the present invention.

Figure 3:
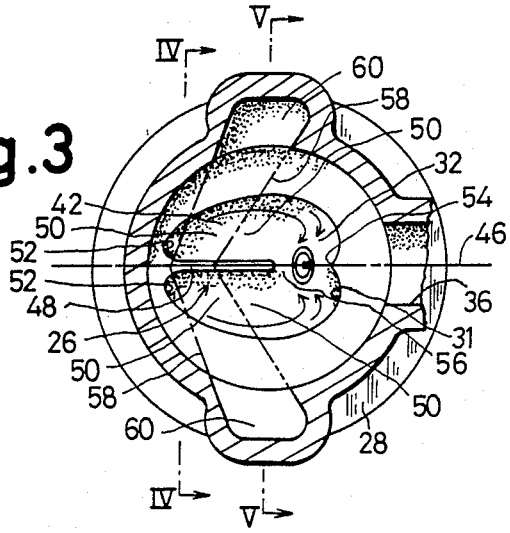
FIG. 3 is a sectional view taken along line III—III of FIG. 2.

In a two-cycle internal combustion engine of the illustrated embodiment, a top chamber 26 is formed in an upper dome-like section 24 so as to constitute a part of a combustion chamber 22. In the illustrated embodiment, the top chamber 26 is arranged in such a manner that its center is eccentric with respect to a central axis of a cylinder 10, although the present invention is not limited to such construction. Also, in the illustrated embodiment, the top chamber 26 is formed at a lower end thereof constituting a circumferential border 31 between the top chamber 26 and a squish chamber 30 into a substantially elliptic shape as shown in FIG. 3, however, it is not limited to such an elliptic shape. Also, the top chamber 26 is preferably formed into a width which is gradually decreased in a direction from the axis of the cylinder 10 to the center of the top chamber 26 as shown in FIG. 3. An ignition plug 32 is so arranged that its tip end 34 is positioned in the top chamber 46 so as to be on a vertical plane 46 defined so as to extend through the top chamber 26. In the illustrated embodiment, the vertical plane 46 is defined so as to extend through a longitudinal axis of the top chamber 26 based on its elliptic lower end 31. Also, in the illustrated embodiment, the tip end 34 of the ignition plug 32 is positioned in a manner to be positionally biased to one side of the top chamber 26.

Figure 2:
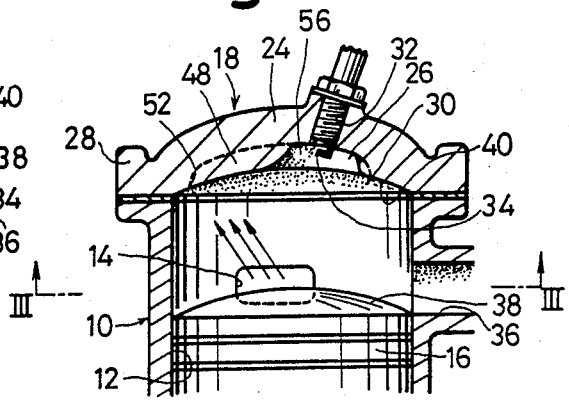
FIG. 2 is a fragmentary sectional view showing an embodiment of a two-cycle internal combustion engine according to the present invention.
Figure 4:
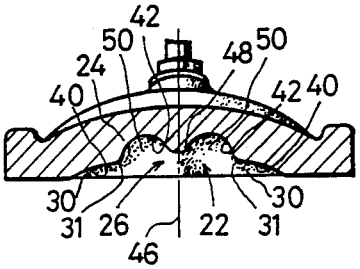
FIG. 4 is a sectional view taken along line IV—IV of FIG. 3.
Figure 5:
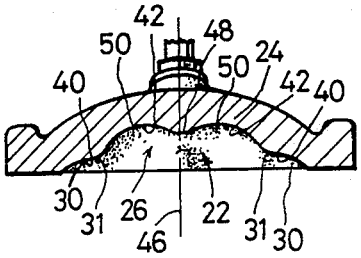
FIG. 5 is a sectional view taken along line V—V of FIG. 3.

The top chamber 26, as shown in FIGS. 2 and 3, is provided with a partition 48 in a region thereof apart from the ignition plug 32 in a manner to extend substantially along the vertical plane 46 from one end of the top chamber 26 toward the ignition plug 32 by a distance, to thereby separate the region of the top chamber 26 into two compartments 50. In the illustrated embodiment, the partition 48 is arranged in a manner to be vertically extend substantially along the vertical plane 46 and laterally extend from an end of the top chamber more apart from the biasedly arranged ignition plug 32 toward the ignition plug 32 substantially along the longitudinal axis of the top chamber 26, so that the region of the top chamber 26 may be divided into two such compartments 50, as shown in FIGS. 3 to 5. In the illustrated embodiment, the partition 48 is formed integral with the cylinder head 18 by downwardly projecting a part of a wall of the cylinder head 18 into the top chamber 26 substantially along the vertical plane 46 to a level of the circumferential border 31. Also, the partition 48 is so formed that its vertical length is gradually decreased from the one end of the top chamber 26 toward the ignition plug 32 as shown in FIGS. 4 and 5. Further, the partition 48 is formed into a gently curved shape in vertical cross section, as shown in FIGS. 4 and 5. The top chamber 26 is formed with corners 52 on both sides of the one end of the top chamber with the partition being interposed therebetween. The corners 52 serve to direct fuel gas supplied to the top chamber 26 toward the ignition plug 32 along an inner surface 42 of the cylinder head 18 defining the top chamber 26. In the illustrated embodiment, the compartments 50 each are gradually narrowed toward the corner 52.

The top chamber 26 is also formed at the other end thereof along its longitudinal axis or its end nearer the ignition plug 32 therealong with a projection 54, which is formed so as to project toward the ignition plug 32 and into a gently curved shape in section. Thus, the ignition plug 32 is positioned in a space 56 of the top chamber 26 defined between a tip end of the partition 48 and a tip end of the projection 54.

A side wall 12 of the cylinder 10 is formed with two scavenging ports 14 although only one of them is shown in FIG. 2. The scavenging ports 14 are arranged so as to cause fuel gas supplied therethrough to the combustion chamber 22 to be then fed through the partition 48 to the corners 52 of the compartments 50, respectively. Two streams of fuel gas supplied through the scavenging ports 14 to the combustion chamber 22 are guided along courses as indicated at reference numeral 58 and at two-dot chain lines in FIG. 3. Supply of fuel gas to the scavenging ports 14 is carried out through fuel gas passages 60.

The ignition plug 32 is threadedly fixed on the upper dome-like section 24 of the cylinder head. It may be obliquely arranged so that the tip end 34 may be obliquely upwardly directed toward the partition 48.

As described above, in the illustrated embodiment, the ignition plug 32 is arranged in a manner to be positionally biased to one side of the top chamber 26. In this instance, the ignition plug may be positioned on the central axis of the cylinder 10 so long as the top chamber 26 is formed in the upper dome-like section 24 in the manner that its center is eccentric with respect to the central axis of a cylinder 10, although such construction is not essential to the present invention.

Figure 1:
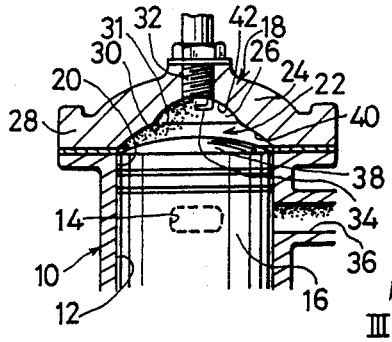
Fig.1 PRIOR ART
FIG. 1 is a fragmentary sectional view showing a conventional two-cycle internal combustion engine.

The remaining of the illustrated embodiment may be constructed in substantially the same manner as the prior art described above with reference to FIG. 1.

Now, the manner of operation of the two-cycle internal combustion engine of the illustrated embodiment described above will be described hereinafter.

When a piston 16 is lowered, fuel gas is upwardly supplied from a crank case (not shown) through the fuel gas passages 60 and scavenging ports 14 to the combustion chamber 22. Then, the fuel gas is separated into two streams by the partition 48 and then guided to the corners 52 of the compartments 50. Subsequently, the two streams of fuel gas are directed toward the ignition plug 32 by the corners 52 and guided along the inner surface or ceiling 42 of the cylinder head 18 defining the top chamber 26 toward the ignition plug 32 in the compartments 50. Thereafter, the streams are merged with each other in the space 56 of the top chamber 26 in which the tip end 34 of the ignition plug 32 is arranged. Thus, it will be noted that flowing of fuel gas through a flow passage defined in the combustion chamber in a manner as described above causes sufficient swirling motion to be imparted to fuel gas reaching the space 56. Supply of fuel gas to the combustion chamber 22 described above causes combustion gas formed due to previous combustion of fuel gas in the combustion chamber 22 to be forcedly discharged through a discharge port 36. Then, when the piston 2 is raised to a level just before a top dead center, fuel gas is ignited by the ignition plug 32. At this time, fuel gas which reached the space 56, as described above, is provided with sufficient swirling motion as noted above because fuel gas is separated into two streams by the partition 54, changed in its flowing direction by the corners 52 and merged together in the space 56, so that atomization of the fuel gas may be highly promoted. This results in an improvement in ignitability and an increase in combustion efficiency to lead to an improvement in an output of the engine and a decrease in fuel consumption. Also, an increase in combustion efficiency leads to a decrease in a content of noxious gas such as carbon monoxide in combustion gas or exhaust gas.

Ignition is carried out with respect to fuel oil supplied to the space 56 of the top chamber 26, resulting in a flame of the fuel gas being formed. The so-formed flame is propagated along the inner surface 42 of the upper dome-like section 24, during which a direction of propagation of the flame is regulated by the partition 48 to cause the flame to reach the corners 52. Then, the flame is propagated through the corners 52 to the squish chamber 30 to forcibly lower the piston 16. The flame, as described above, is advanced along the inner surface 42 of the upper dome-like section 24. This means that the flame is propagated over a long distance from the ignition plug 32 to the corners 52. Thus, a time required for propagation of the flame is extended, resulting in a rapid increase in pressure in the combustion chamber being prevented. Accordingly, impulse force applied to the cylinder 10, piston 16 and cylinder head 18 is restrained to a low level to lead to a decrease in vibration and noise during actuation of the engine.

As can be seen from the foregoing, in the present invention, the ignition plug is so disposed that its tip end is arranged in the top chamber and positioned on a vertical plane extending through the top chamber and the partition is provided in the region of the top chamber apart from the ignition plug in a manner to extend substantially along the vertical plane from one end of the top chamber by a distance toward the ignition plug, to thereby divide the region into two compartments. Also, the partition cooperates with the top chamber to form corners on both sides of the one end of the top chamber with the partition being interposed therebetween so that they may serve to direct fuel gas supplied to the top chamber toward the ignition plug. Further, in the present invention, the scavenging ports are arranged to feed fuel gas through the partition to the corners and the exhaust port is arranged on a side of the cylinder wall opposite to the corners. Thus, it will be noted that the present invention accomplishes an improvement in ignitability and an increase in combustion efficiency to lead to an improvement in an output of the engine and a decrease in fuel consumption, as well as a decrease in a content of noxious gas such as carbon monoxide in combustion gas or exhaust gas due to an increase in combustion efficiency; because fuel gas supplied to the cylinder head is separated into two streams by the partition, guided to the corners of the compartments, directed toward the ignition plug by the corners, guided along the inner surface of the cylinder head defining the top chamber toward the ignition plug in the compartments, and then merged with each other in the space of the top chamber in which the tip end of the ignition plug is arranged, resulting in sufficient swirling motion being imparted to fuel gas reaching the space. Also, the construction of the present invention causes flame formed by ignition of fuel gas to be propagated over a significantly long distance from the ignition plug to the corners, so that a time required for propagation of the flame may be substantially extended, resulting in a rapid increase in pressure in the combustion chamber being prevented. Accordingly, impulse force applied to the cylinder, piston and cylinder head is restrained to a low level to lead to a decrease in vibration and noise during actuation of the engine.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A two-cycle internal combustion engine comprising:

a cylinder having a cylinder wall formed with a plurality of scavenging ports and a discharge port;

a cylinder head for covering a top of said cylinder;

a piston movably arranged in said cylinder;

said cylinder, cylinder head and piston cooperating together to define a combustion chamber, said cylinder head being formed therein with a top chamber constituting a part of said combustion chamber;

an ignition plug of which a tip end is arranged in said top chamber and positioned on a vertical plane extending through said top chamber; and a partition provided in a region of said top chamber apart from said ignition plug in a manner to extend substantially along said vertical plane from one end of said top chamber by a distance toward said ignition plug, to thereby divide said region into two compartments;

said partition cooperating with said top chamber to define corners on both sides of said one end of said top chamber with said partition being interposed therebetween, said corners serving to direct fuel gas supplied to said top chamber toward ignition plug;

said scavenging ports being arranged to feed fuel gas through said partition to said corners;

said discharge port being arranged on a side of said cylinder wall opposite to said corners.

2. A two-cycle internal combustion engine as defined in claim 1, wherein said top chamber is formed at the other end thereof opposite to said one end along said vertical plane with a projection in a manner to project toward said tip end of said ignition plug.

3. A two-cycle internal combustion engine as defined in claim 1, wherein said tip end of said ignition plug is eccentric with respect to said top chamber.

4. A two-cycle internal combustion engine as defined in claim 1, wherein top chamber is eccentric with respect to said cylinder.

5. A two-cycle internal combustion engine as defined in claim 1, wherein said top chamber is formed at a lower end thereof into an elliptic shape;

said partition being provided along a longitudinal axis of said top chamber based on said elliptic lower end of said top chamber.

6. A two-cycle internal combustion engine as defined in claim 5, wherein said partition is formed integral with said cylinder head.

7. A two-cycle internal combustion engine as defined in claim 5, wherein said partition is formed in such a manner that its vertical length is gradually decreased from said one end of said top chamber toward said ignition plug.

8. A two-cycle internal combustion engine as defined in claim 5, wherein said partition is formed into a gently curved shape in vertical cross section.

9. A two-cycle internal combustion engine as defined in claim 1, wherein each of said compartments is gradually narrowed toward said corner.

10. A two-cycle internal combustion engine as defined in claim 4, wherein said top chamber is formed into a width gradually decreased in a direction form an axis of said cylinder to a center of said top chamber.

11. A two-cycle internal combustion engine as defined in claim 4, wherein said ignition plug is so arranged that said tip end is positionally biased to one side of said top chamber.

* * * * *